US005515597A

United States Patent [19]

Herbst et al.

[11] Patent Number: 5,515,597

[45] Date of Patent: May 14, 1996

[54] METHOD FOR ASSEMBLING A CURRENT TRANSFORMER

[75] Inventors: Leroy J. Herbst, Raleigh; Michael W. Knight, Fuquay-Varina, both of N.C.

[73] Assignee: Square D Company, Palatine, Ill.

[21] Appl. No.: 144,110

[22] Filed: Oct. 27, 1993

[51] Int. Cl.[6] ..... H01F 41/02

[52] U.S. Cl. ..... 29/605; 242/46.21; 242/434.5

[58] Field of Search ..... 29/605; 242/7.03, 242/4 R, 46.2, 46.21

[56] References Cited

U.S. PATENT DOCUMENTS

| | | | |
|---|---|---|---|
| 2,305,999 | 12/1942 | Steinmayer et al. | 29/605 X |
| 2,414,603 | 1/1947 | Nelson | 242/4 R |
| 3,043,000 | 7/1962 | Hatfield | 242/4 R X |
| 4,325,045 | 4/1982 | Mehl | 29/605 X |
| 4,638,554 | 1/1987 | Beisser | 29/605 |

*Primary Examiner*—Carl E. Hall
*Attorney, Agent, or Firm*—David Russell Stacey; Larry I. Golden; Larry T. Shrout

[57] ABSTRACT

A method for laminating a magnetic core of a three-phase current transformer uses a continuous length of magnetic metal material and a mandrel having first, second, third, and fourth sets of pins mounted to a mandrel plate. The second and third pin sets are located adjacent one another, adjacent the respective first and fourth pin sets, and between the first and fourth pin sets. The third and fourth pin sets are movable between a retracted position within the mandrel plate and an extended position extending from the mandrel plate. The third and fourth pin sets are first positioned in the retracted position, and a first portion of the length of magnetic material is wound about the first and second pin sets to form the first phase section of the magnetic core. After moving the third pin set to the extended position, a second portion of the length of magnetic material is wound about the first and third pin sets to form the second phase section. After moving the fourth pin set to the extended position, a third portion of the length of magnetic material is wound about the first and fourth pin sets to form the third phase section, thereby forming the magnetic core. In another lamination method, each phase section is separately formed by continuously winding a respective length of magnetic metal material about a respective rotating mandrel. The magnetic core is formed by connecting the separately laminated phase sections.

5 Claims, 8 Drawing Sheets

METHOD FOR ASSEMBLING A CURRENT TRANSFORMER

FIELD OF THE INVENTION

The present invention generally relates to current transformers and, more particularly, relates to a method for assembling a current transformer.

BACKGROUND OF THE INVENTION

A transformer includes two or more multiturn coils of wire placed in close proximity to cause the magnetic field of one coil to link to the magnetic field of the other coil. The transformer is used to transfer electric energy from one circuit to another circuit using magnetic induction. A current transformer, in particular, includes a primary coil connected in series with a circuit carrying the current to be measured, and a secondary coil across which the current is measured. One type of current transformer, known as a three-phase current transformer, is used in a three-phase circuit and includes three sets of primary and secondary windings. Each secondary winding of the three-phase circuit measures the current passing through its respective primary winding.

The magnetic field generated by the current in a primary coil may be greatly concentrated by providing a core of magnetic material on which the primary and secondary coils are wound. This increases the inductance of the primary and secondary coils, so that a smaller number of turns may be used. A closed core having a continuous magnetic path also ensures that practically all of the magnetic field established by the current in the primary coil will reduce the number of turns of the secondary coil.

Eddy currents are currents induced in the magnetic core by the magnetic fields of the primary and secondary windings. To minimize the energy lost due to these eddy currents, the magnetic core is formed by building it up from laminations stamped from sheet iron or steel. These laminations are, for the most part, insulated from each other by surface oxides and sometimes also by the application of varnish. After forming the laminated core, the closed core is sectioned into two parts so that preformed primary and secondary coils may be placed over different laminated legs of the magnetic core. After the primary and secondary coils are placed over the laminated legs, the two parts of the sectioned core are reattached to one another.

The foregoing technique for assembling current transformers suffers from several drawbacks. One drawback is that the foregoing assembly technique may lead to a loss of magnetic core permeability due to assembly interface air gaps, eddy currents, and opposing material grain directions and stresses in stamped core laminations. These deficiencies, in turn, produce relatively large variabilities. Another drawback is that core laminations in the above assembly technique use an involved assembly process requiring stamping, orienting, stacking and fastening of the core laminations. Yet another drawback is that the assembly technique results in inefficient magnetic flux paths, thereby increasing the required size of the current transformers. A further drawback is that the core lamination material used in the assembly technique is relatively thick because the laminations are stamped, oriented, stacked, riveted and in general handled as individual components. The thicker lamination material, in turn, increases eddy currents and bending stresses, resulting in a decrease in magnetic core permeability. Another drawback is that stamping methods used in the assembly technique produce a high percentage of scrap, which results in a waste of expensive magnetic iron material. In addition, these stamping methods produce stresses in the magnetic iron material which degrade magnetic core permeability.

A need therefore exists for a method for assembling a current transformer which overcomes the above-noted drawbacks associated with existing assembly techniques.

SUMMARY OF THE INVENTION

In accordance with the foregoing, the present invention provides a method for laminating a magnetic core of a current transformer.

After forming a magnetic core, the present invention provides a method for winding a primary or secondary coil on a magnetic core. In this method, a bobbin is first positioned over a leg of the magnetic core with the leg of the magnetic core extending through an axial hole in the bobbin. Next, a leading end of a length of electrically conductive wire is connected to a first side flange of the bobbin. The bobbin is rotated about the axis of the leg to draw the electrically conductive wire about an outer surface of the bobbin between the first side flange and a second side flange. Finally, a trailing end of the length of electrically conductive wire is connected to the second side flange of the bobbin.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which.

Figure 1:
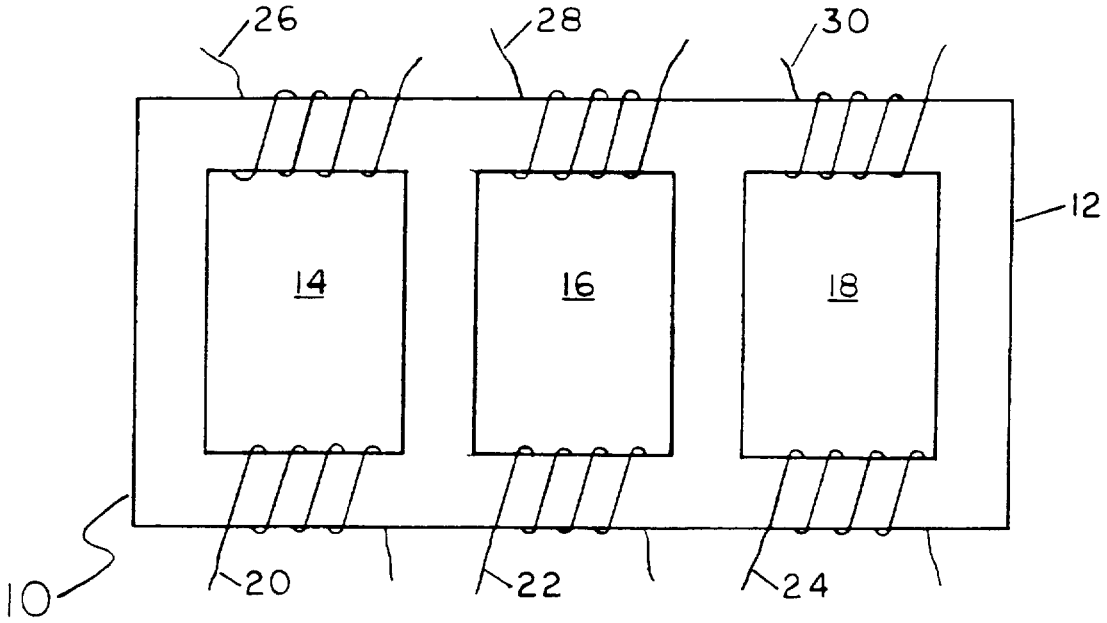
FIG. 1 is a perspective view of a three-phase current transformer assembled in accordance with the method of the present invention.

While the invention is susceptible to various modifications and alternative forms, specific embodiments thereof have been shown by way of example in the drawings and will be described in detail. It should be understood, however, that it is not intended to limit the invention to the particular form described. On the contrary, the intention is to cover all modifications, equivalents and alternatives falling within the spirit and scope of the invention as defined by the appended claims.

DETAILED DESCRIPTION OF THE PREFERRED EMBODIMENT

Turning now to the drawings, FIG. 1 illustrates a three-phase current transformer 10 including a laminated magnetic core 12 with three closed phase sections 14, 16, 18, three primary coils 20, 22, 24, and three secondary coils 26, 28, 30. The current transformer 10 is assembled in two stages: (1) laminating the magnetic core 12, and (2) winding primary and secondary coils about different legs of each core section. Each of these assembly stages is described in detail below.

First, a magnetic core 12' is formed by the process of lamination. Referring to FIG. 2, the laminated core 12' is generated on a three-stage mandrel 32 from a continuous movie film-like reel 34 of magnetic iron material in the form of a strip slitted to the correct width. The three-stage mandrel 32 is provided with four parallel sets of twin pins 36, 38, 40, and 42. The first and second pin sets 36, 38 each include two parallel stationary pins permanently extending from a mandrel plate 44, while the other two pin sets 40, 42 each include two parallel pins extendable from the plate 44 and retractable into the plate 44 using the controller 46.

To initiate the lamination winding process, the leading end of the iron strip is threaded to the winding mandrel 32 through appropriate tensioners or guides as required to control the winding process. To form the first phase section 14' of the magnetic core 12', the leading end of the iron strip is attached to one of the pins in the first pin set 36 by either bending the leading end over the pin, taping the leading end to the pin, inserting the leading end into a slot in the pin, or some other attachment means. The pins in the first and second pin sets 36, 38 are evenly spaced about a rotating axis 47 of the winding mandrel 32. At this time, the remaining two pins sets 40 and 42 are in a retracted position within the plate 44. Next, the mandrel plate 44, driven by a motor 48, is rotated so that the strip of iron material is pulled over the pins in the first and second pin sets 36, 38.

After the desired number of turns is achieved on the first phase section 14', the controller 46 extends the two pins in the third pin set 40 from the mandrel plate 44. These pins, which are located at a larger distance from the rotating axis 47 than the pins in the second pin set 38, catch the iron strip so that subsequent windings are wrapped around the third pin set 40 at one end while continuing to layer on three sides of the first phase section 14'. After the desired number of turns is achieved on the second phase section 16', the controller 46 extends the two pins in the fourth pin set 42 from the mandrel plate 44. These pins, which are located at a larger distance from the rotating axis 47 than the third pin set 40, catch the iron strip so that subsequent windings are wrapped around the fourth pin set 42 at one end while continuing to layer on three sides of the first and second phase sections 14', 16'. Due to this continued layering, the first phase section 14' is thicker over a greater percentage thereof than the second phase section 16' which, in turn, is thicker over a greater percentage thereof than the third phase section 18'. The end of the strip is cut and secured to the finished core 12' by taping, laser welding, gluing or any process which does not adversely affect the permeability of the magnetic core 12'.

In the preferred embodiment, each of the three sections of the core 12' preferably includes one leg having the same cross-sectional area for equal flux density. In FIG. 2, the legs 50, 52, and 54 are generated with the same cross-sectional area by performing an equal number of winding revolutions for each of the three phase sections 14', 16', and 18'. Alternatively, variation in the cross-sectional area of the legs 50, 52, and 54 is attained by varying the number of winding revolutions performed from one phase section to the next.

Figure 2A:
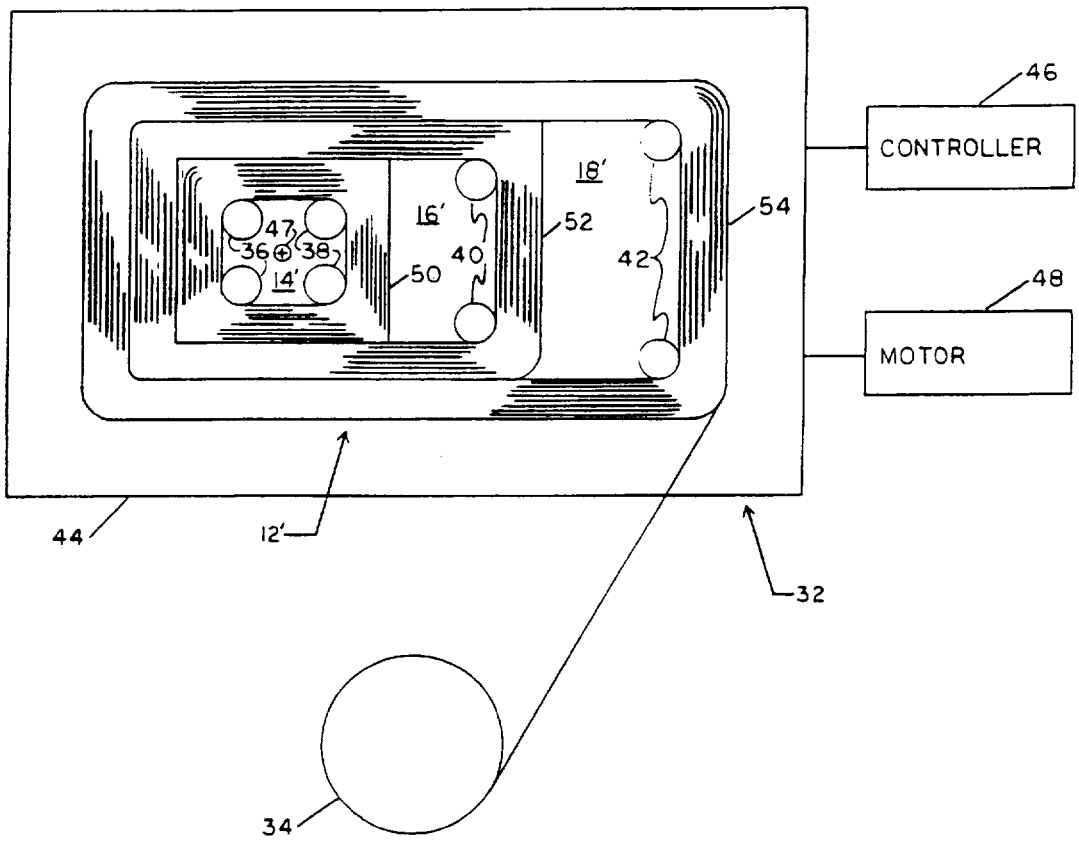
FIG. 2 illustrates a method for laminating a three-phase magnetic core in accordance with the present invention.

The shape of the core 12' may be virtually any closed loop configuration determined by the number of mandrel pins and the mandrel pin placement. In FIG. 2A, for example, the pins in the fourth pin set 42 are spaced farther apart than the pins in the third pin set 40 which, in turn, are spaced farther apart than the pins in the second pin set 38. Since the midpoints of the four pin sets are collinear, each of the three phase sections 14', 16', and 18' may be laminated into a rectangular shape so that the finished core 12' has a rectangular shape. In an alternative embodiment, depicted in FIG. 2B, the pins in each pin set are spaced equidistant from one another so that the three legs 50', 52', and 54' have the same lengths. Such mandrel pin placement generates a core 12' having the illustrated non-rectangular configuration.

Figure 2B:
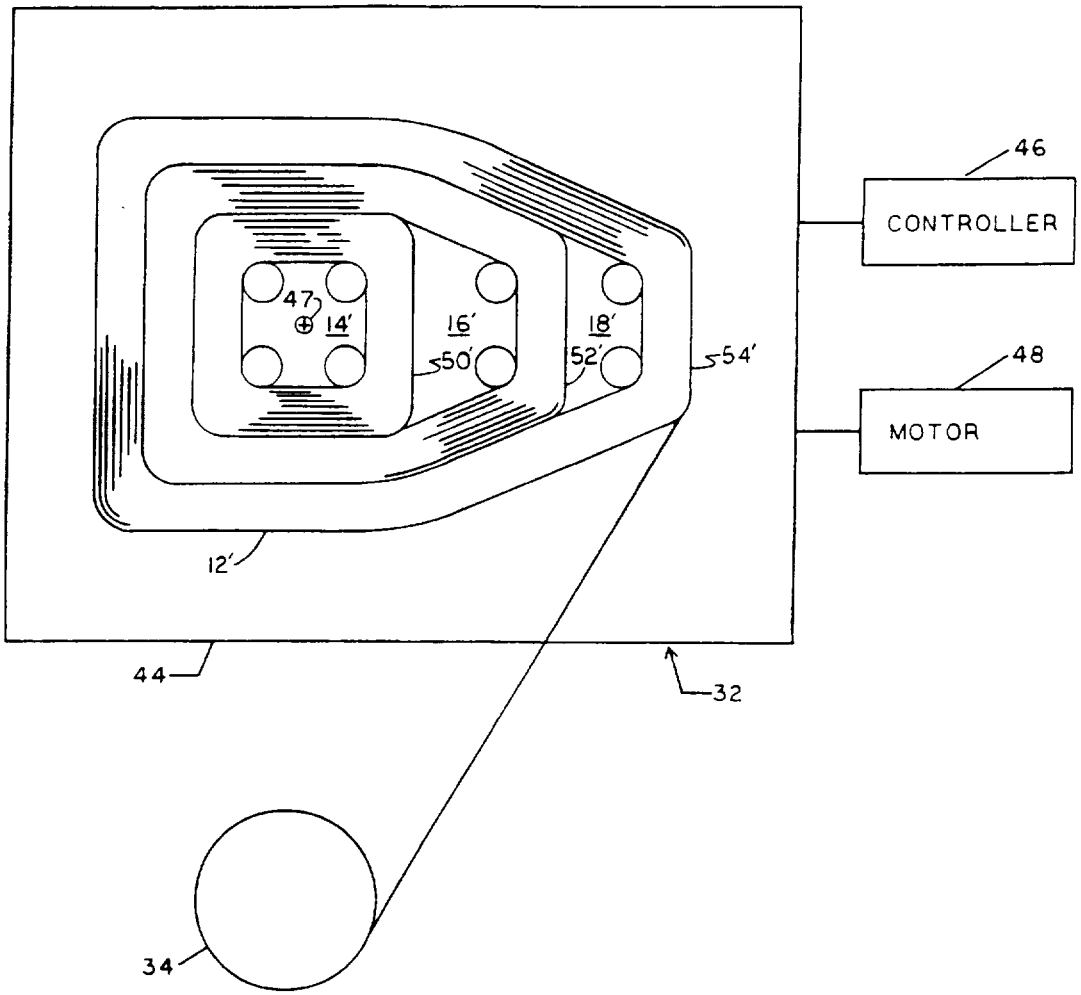

The three phase sections 14', 16', and 18' generated using the lamination process in FIGS. 2A and 2B are not identical. In an alternative embodiment, shown in FIG. 3, the lamination process separately generates three identical phase sections 14', 16', and 18', and then later attaches the phase sections to one another. Instead of being generated by common sets of pins, the phase sections 14', 16', and 18' are separately and simultaneously formed using three pin sets 56, 58, and 60. As the winding process employing these pin sets is similar to the winding process described in connection with FIG. 2, it will not be described in detail herein. It suffices to say that the pins in the pin sets 56, 58, and 60 permanently extend from three mandrel plates rotatably driven by one or more motors. Each of the pin sets is separately fed by a respective reel of iron material. The leading end of the magnetic strip of iron material on each reel is threaded to the respective mandrel plate and attached to its respective pin set. To form the phase sections 14', 16', and 18', the mandrel plates are rotated at the same speed so that the respective continuous iron strips are pulled around the pins of the respective pin sets. The grain directions of the laminations for each phase section are shown by the arrows in FIG. 3. After the desired number of turns is achieved, the end of each iron strip is cut and attached to its respective winding. While FIG. 3 illustrates the phase sections 14', 16', and 18' as being formed simultaneously from the three pin sets 56, 58, and 60, the phase sections may alternatively be formed one after another on one pin set.

Since the lamination process in FIG. 3 separately generates the three identical phase sections 14', 16', and 18', these phase sections must subsequently be connected to one another. When viewed at the end of the winding operation, each of the three laminated cores have the same grain structure orientation, and the two center legs 62, 64 of the second phase section 16' accordingly have grain directions opposing the grain directions of the respective adjacent legs 60, 66. To enhance magnetic permeability of the core formed from the three phase sections, these sections are preferably positioned so that the material grain directions of adjacent legs are not orthogonally oriented since this would impede the flux. In particular, prior to connecting the phase sections to one another, the second phase section 16' is rotated 180° about its central vertical axis so that the legs 62, 64 switch positions. The leg 62 moves from the right side of the second phase section 16' to the left side, while the leg 64 moves from the left side to the right side. In this reoriented position, the grain direction of the leg 62 matches the grain direction of the adjacent leg 66 of the first phase section 14'. Similarly, the grain direction of the leg 64 matches the material grain direction of the adjacent leg 68 of the third phase section 14'.

Figure 3A:
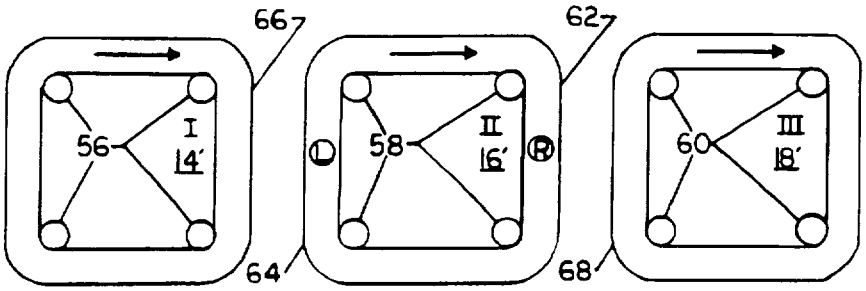
FIG. 3 illustrates another method for laminating a three-phase magnetic core in accordance with the present invention.
Figure 3B:
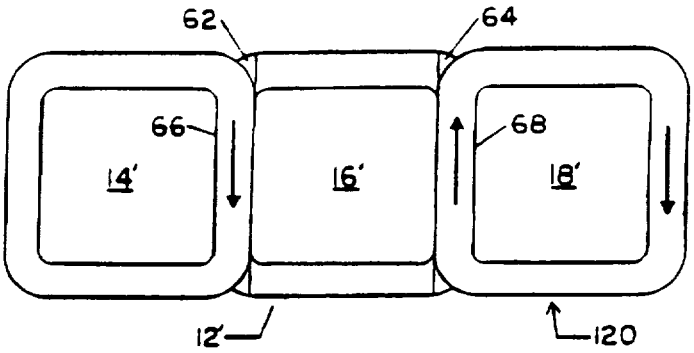
Figure 3C:
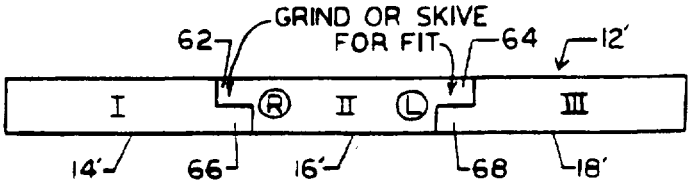
Figure 3D:
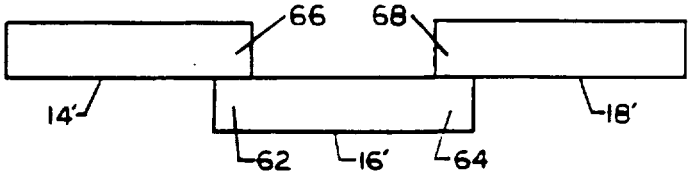

To attach the phase sections to one another, the legs 62 and 66 are notched (e.g., by skiving or grinding) to fit together so that the phase section 14' may be connected to the phase section 16' (FIGS. 3B and 3C). Similarly, the legs 64 and 66 are notched to fit together so that the phase section 16' may be connected to the phase section 18'. The mating notches in the legs 62, 64, 66, and 68 also insures that the cross-sectional areas of all ten legs of the finished core 12' are the same. Alternatively, however, the legs 62, 64, 66, and 68 are not notched, but rather connected as shown in FIG. 3D.

Figure 4A:
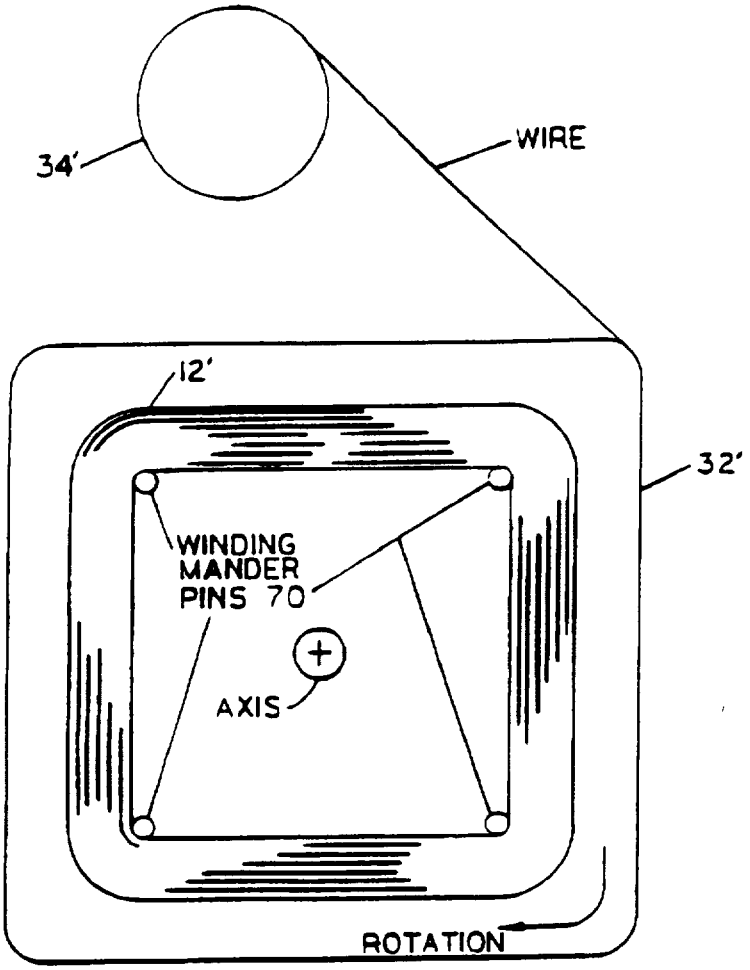
FIG. 4 illustrates yet another method for laminating a phase section of a single or multi-phase magnetic core in accordance with the present invention.
Figure 4B:
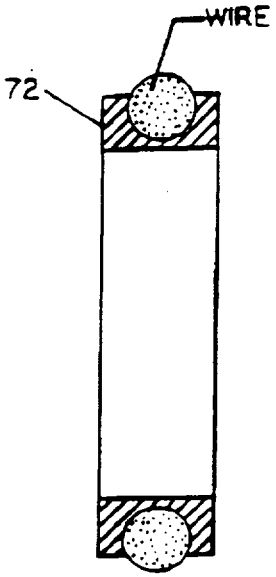

In another alternative embodiment, shown in FIG. 4, a single-phase laminated core 12' is generated on a mandrel 32' from a continuous reel 34' of iron wire stock preferably having either a round, rectangular, or square cross-section. After the leading end of the wire stock is attached to one of the pins of the pin set 70, the mandrel 32' is rotated to draw the wire about the pins. Since this lamination process uses wire stock instead of a strip of iron material, the winding method dictates the cross-sectional shape of the generated core 12'. More specifically, while the wire is drawn about the rotating pins, the cross-sectional shape of the generated core 12' is controlled by controlling the position of the wire. The position of the wire may be controlled by any number of means, including movement of the reel 34' relative to the mandrel 32' or using a separate mechanism to guide the wire as it is drawn about the rotating pins. Alternatively, the pin set 70 may be substituted with a premolded bobbin 72 mounted to the mandrel 32' and used to hold, guide, and shape the core 12' during the winding process. The wire drawn about the outer peripheral surface of the bobbin 72 takes on the shape configured therein. For example, wire drawn about the bobbin 72 shown in FIG. 4 will take on the round shape molded into the outer peripheral surface of the bobbin 72. The outer peripheral surface may also be molded so that the cross-section of the generated core 12' has a square, rectangular, oblong, or radiused (curved) configuration. The laminated core is not limited to a square or rectangular cross-section. The cross-sectional shape of the generated core 12' is easily modified, without expensive and time-consuming tooling changes, by replacing the bobbin 72 with another bobbin having a differently-configured outer peripheral surface. Thus, the foregoing lamination process employing wire stock allows one to generate a core cross-section conforming to the cross-sectional shape of differently configured primary and secondary windings to be placed about the core. The lamination process in FIG. 4 may also be used to generate a three-phase laminated core by generating two additional phase sections, placing the phase sections adjacent one another with the material grain structures of adjacent legs pointing in the same direction, and connecting the three phase sections in the manner described in connection with FIG. 3.

The lamination processes described in connection with FIGS. 2–4 are advantageous because they eliminate the need for such steps as stamping, heat-treating, and rivetting, required in many existing techniques for assembling current transformers. Since these lamination processes use relatively thin strips of iron material (e.g., down to 0.001" foil), they minimize magnetic permeability loss resulting from eddy currents. Also, the lamination processes further minimize permeability loss because they do not generate assembly air gaps or stamping stresses and because they need not employ rivets or fasteners which interfere with the magnetic flux path through the magnetic core. In addition, the lamination processes enhance magnetic permeability by insuring that the material grain direction is the same as the magnetic flux path. By increasing the efficiency in the magnetic flux path, the transformers produced using the lamination processes may be relatively small in size. Moreover, the lamination processes permit the cross-sectional area and magnetic flux density of each phase section to be controlled without requiring any additional tooling or equipment. The magnetic and dimensional properties of the magnetic core are controlled simply by changing the number of turns, the tightness of the windings, and the width of iron strip. The film winding equipment required by these processes is relatively simple and inexpensive compared to the stamping tools and equipment used in existing lamination techniques.

After laminating the magnetic core, primary and secondary coils are wound about different legs of each phase section. The circuitry employing the current transformer may only dictate that secondary coils be generated about the laminated core so that primary coils are not necessary. Since the method for winding both the primary and secondary coils about the laminated core is identical, the description below will focus on winding the secondary coil about the laminated core. It should be understood, however, that the primary coils (if required) are generated about the laminated core using the same winding method.

Referring to FIG. 5, with a laminated core 12' secured tightly in position, as an option the laminated core 12' can be placed into a molding press and a straight portion (i.e., leg) of the laminated core 12' is overmolded with a hard plastic 74. The outer surface of this overmold 74 is cylindrical in shape and is oriented parallel to the core laminations. This plastic overmold 74 serves as a bearing surface and as a means of bonding the core laminations together.

Next, a premolded hinged bobbin 76 is snapped over the bearing surface provided by the plastic overmold 74. The bobbin 76 is designed with an axial cylindrical cavity 78 and a cut-out side 80 split down one side of the bobbin 76 parallel to the direction of the axial cylindrical cavity 78. Furthermore, the bobbin 76 is designed so that the cut-out side 80 may flex sufficiently to fit over and close onto the plastic overmold 74. When the bobbin 76 is fully closed onto the plastic overmold 74, the inner diameter of the cylindrical cavity 78 is slightly larger than the outer diameter of the plastic overmold 74 to permit the bobbin 76 to freely rotate about the plastic overmold 74. An alternative to using the hinged bobbin 76 is to use a two-piece bobbin secured over the plastic overmold 74 by placing the two bobbin halves over the plastic overmold 74 and then attaching these halves to one another by such means as snapping, gluing, welding, etc.

Another alternative to the hinged or two-piece bobbin is to overmold over the bearing surface of the bobbin, the bobbin being a dissimilar material to the bearing material, such that material shrinkage between the bearing and the bobbin will cause a gap at the interface and will allow the bobbin to freely rotate over the bearing surface. For example, the bearing surface can be nylon material (e.g., polymer) and the bobbin material can be selected so as to have a predetermined shrinkage to permit free cooperation there between.

Figure 5A:
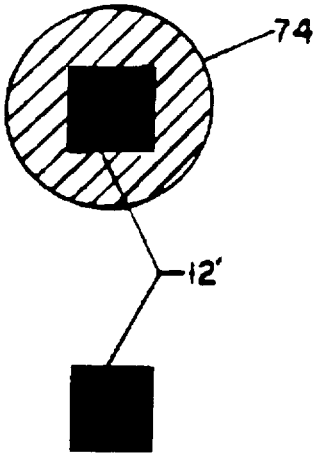
FIG. 5 illustrates a method for winding coil onto a closed magnetic core in accordance with the present invention.
Figure 5B:
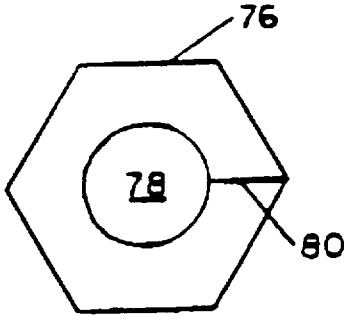
Figure 5C:
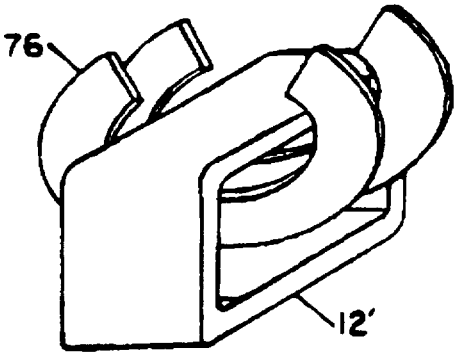
Figure 5D:
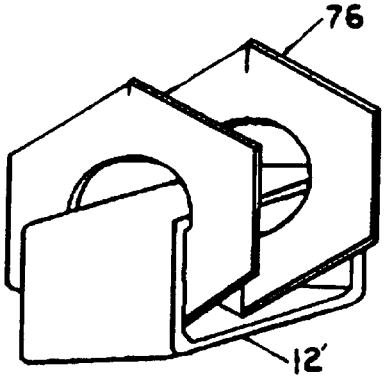
Figure 5E:
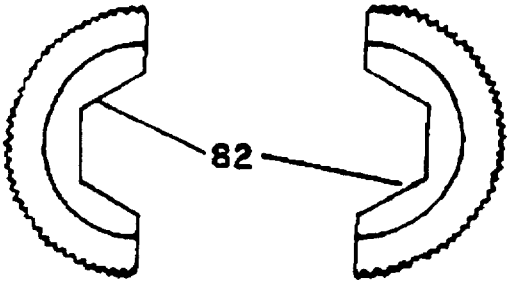
Figure 5F:
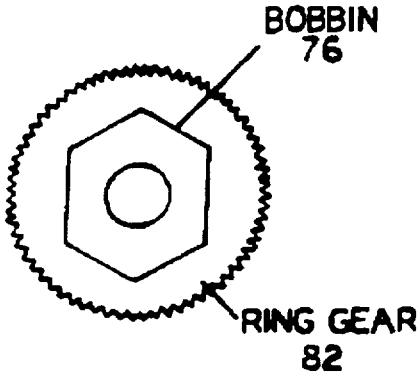
Figure 5G:
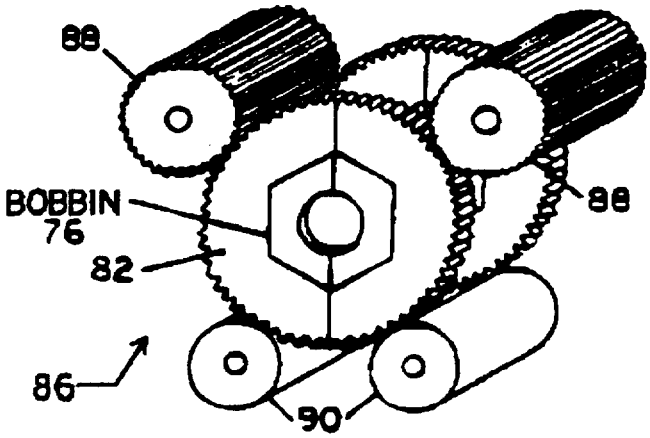

In yet another embodiment, the core 12' as shown in FIG. 5*d* is fixedly positioned relative to the bobbin 76, as shown in FIG. 5*g*, such that the bobbin 76 is free to rotate about the core 12' without the need for a bearing surface being formed on the core.

After placing the bobbin 76 over the plastic overmold 74, a pair of two-piece ring gears 82 are secured over the two end flanges 84 of the bobbin 76. The mating ends of the two halves of the gear 82 may be provided with keys for alignment and symmetry. The inner surfaces of the ring gears 82 are configured to match the configuration of the outer surface of the flanges 84. In the preferred embodiment, the inner surfaces of the ring gears 82 and the outer surfaces of the bobbin flanges 84 are shaped as mating hexagons, squares, or some other non-cylindrical shape which permits the ring gears 82 to grip the flanges 84 while the ring gears 82 are rotated. The ring gear halves are retained in each half of the fixture and mate to form a concentric ring when the fixture is closed.

This assembly including the laminated core 12', the plastic overmold 74, and the bobbin 76, and the ring gears 82 is then nested into a coil winder 86 with the laminated core 12' and overmold 74 restrained and the bobbin 76 free to rotate thereabout. The coil winder 86 is provided with one or more hardened metal drive gears 88 for driving the ring gears 82 and a set of smooth support rollers 90, which may be either smooth or geared. The drive gears 88 and the support rollers 90 control the rotation and position of the ring gears 82 and bobbin 76. Since the drive gears 88 are rotating against the hardened metal surface of the ring gears 82, instead of the softer plastic surface of the bobbin 76, location, friction, heat and speed are better controlled. This, in turn, enhances the efficiency of the winding process.

To wind wire about the bobbin 76, the leading end of an electrically conductive wire is attached either to a slot in one of the bobbin flanges 84 or to a pin extending from one of the flanges 84. Next, the drive gears 88 are rotated by a motor (not shown), thereby rotating the ring gears 82 and the bobbin 76 and drawing the wire about the bobbin 76. After the desired number of turns for the generated coil are achieved, rotation of the drive gears 88 is stopped and the end of the wire is cut and attached to either a slot or pin at the other bobbin flange 84. If the laminated core includes three phase sections, as in FIGS. 1–3, coils may be wound simultaneously about the three phase sections using the foregoing winding method.

In an alternative embodiment, the ring gears 82 and drive gears 88 are eliminated and at least one friction wheel is positioned to fictionally drive the bobbin flanges 84. The bobbin flanges 84 and friction wheel may be provided with engaging teeth for more positive rotational control.

The foregoing method for spinning the bobbin 76 on a laminated core may be used on cores generated by the lamination process described herein or on cores produced by conventional means (e.g., stamping, powdered metal, etc.).

Figure 6:
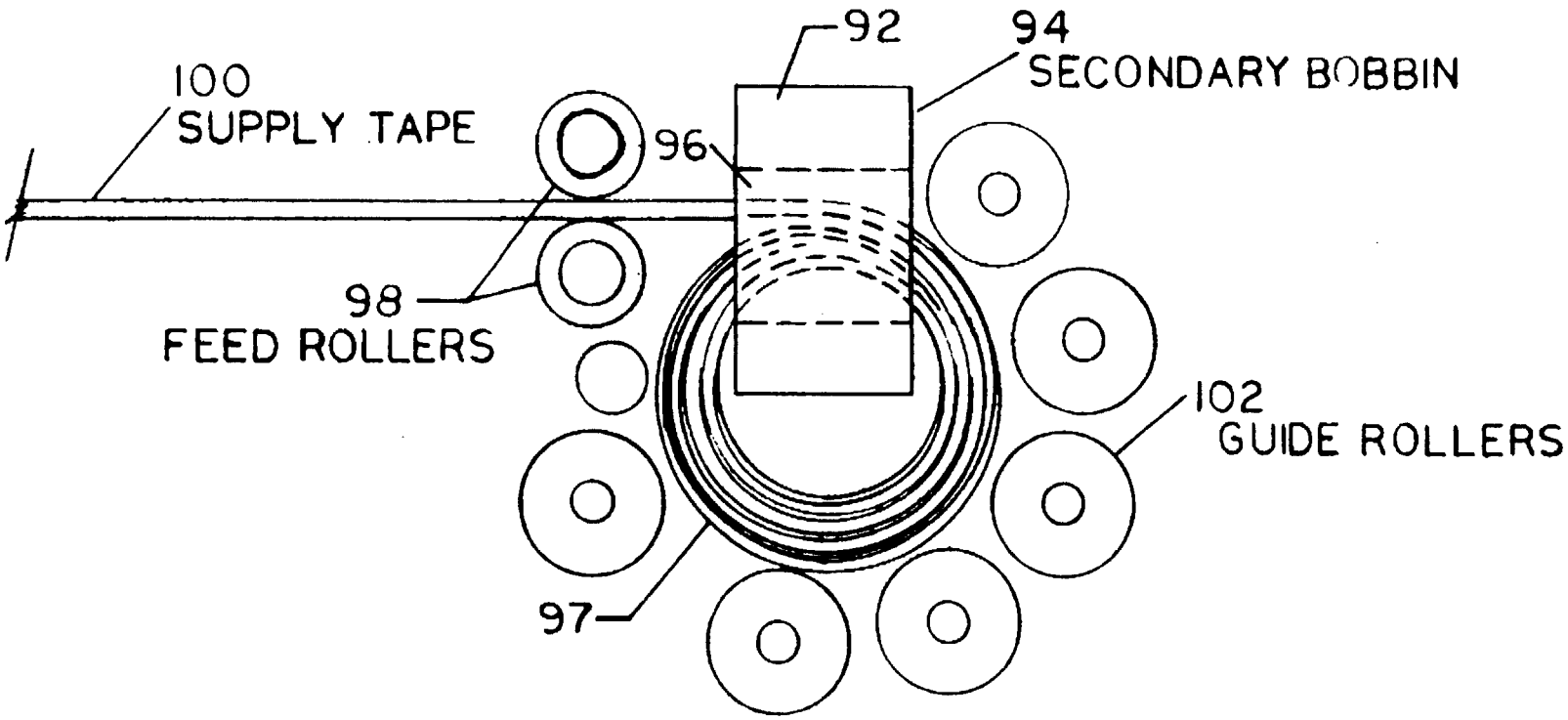
FIG. 6 illustrates a method for assembling a current transformer in accordance with the present invention.

FIG. 6 illustrates yet another alternative method for assembling a current transformer. In this method, a secondary coil 92 is first wound on a bobbin 94 using conventional winding methods. The bobbin 94 includes a rectangular hole 96 which is slightly wider and higher than the respective width and height of the magnetic metal core 97 to be formed therein. Next, using a guided feed system such as flanged feed rollers 98, the leading edge of reeled metal magnetic tape material 100 is fed through the bobbin hole 96 near the top of the hole. The leading edge of the magnetic tape 100 is preferably chamfered to help guide its insertion. An alternative to the feed rollers 98 is a plastic bobbin that the metal tape 100 is wound on. The bobbin is assembled in two halves through the hole 96 of the secondary coil bobbin 94 and is used to pull the tape as it is being wound.

Guide rollers 102 are employed to guide the metal tape 100 around the outside of the bobbin 94 and feed the tape 100 back into the bobbin hole 96. Alternatively, the guide rollers 102 may be substituted with slides, powered rollers, a flanged wheel, or similar guide mechanism. As the feed rollers 98 continue to feed the metal tape 100 into the bobbin hole 96, the guide rollers 102 constrain the other layer of the core 97 while the tape 100 forms metal layers extending inwardly from this outer layer. Within the bobbin hole 96, these inner layers fill a substantial portion of the hole 96 from near the top of the hole 96 to near the bottom of the hole 96. When enough layers have been formed to complete the current transformer, the feed rollers 98 stop feeding metal tape 100 into the bobbin hole 96. Finally, the metal tape 100 is cut between the feed rollers 98 and the bobbin 94. The cut end of the supply tape 100 is the beginning of the next current transformer to be assembled. The cut end of the core 97 is restrained by installing a non-magnetic clip before removing the assembly from the assembly machine. Alternatively, the cut end of the core 97 is restrained by the removal mechanism and held in place by a housing in which the transformer is installed. The foregoing transformer assembly process has the advantages described above in connection with the lamination processes shown in FIGS. 2–4.

While the present invention has been described with reference to one or more particular embodiments, those skilled in the art will recognize that many changes may be made thereto without departing from the spirit and scope of the present invention. Moreover, skilled artisans will recognize that various embodiments have been disclosed herein. For example, instead of the using the foregoing process (FIG. 5) for winding the primary and secondary coils about the laminated core, existing toroidal transformer techniques may be used to wind the wire onto the laminated core. In addition, the plastic overmold 74 is optional and may be eliminated if the bobbin 76 is centrally located over the core leg during the winding operation so that friction between the bobbin 76 and the core 12' is minimal. Each of these embodiments and obvious variations thereof is contemplated as falling within the spirit and scope of the claimed invention, which is set forth in the following claims.

We claim:

1. A method of winding wire on a magnetic core, comprising the steps of:

positioning a bearing surface over a leg of the magnetic core such that the bearing surface forms a generally smooth circular surface about the axis of the leg;

overmolding a bobbin over the bearing surface, the bobbin and the bearing surface being of dissimilar materials selectively chosen such that a gap is formed at the interface of the bobbin and the bearing surface as the bobbin material cools, the gap permitting the bobbin to rotate freely over the bearing surface;

attaching a leading end of a length of electrically conductive wire to a first side flange of the bobbin;

rotating the bobbin about the axis of the leg to draw the electrically conductive wire about an outer surface of the bobbin between the first side flange and a second side flange; and attaching a trailing end of the length of electrically conductive wire to the second side flange of the bobbin.

2. The method of claim 1 wherein the bearing surface includes two interlocking halves, and wherein positioning the bearing surface over the leg of the magnetic core includes separating the two halves, positioning the two halves over the leg adjacent one another, and interlocking the two halves.

3. The method of claim 1 wherein the bearing surface is overmolded about the leg of the magnetic core.

4. The method of claim 1, wherein the step of rotating the bobbin about the axis of the leg includes rotatably driving the bobbin with a drive wheel.

5. The method of claim 1, wherein the step of rotating the bobbin about the axis of the leg includes frictionally driving the flanges of the bobbin with a friction drive wheel.

* * * * *